United States Patent [19]

Wright et al.

[11] Patent Number: 4,636,620

[45] Date of Patent: Jan. 13, 1987

[54] TEMPERATURE COMPENSATION INJECTOR CONTROL SYSTEM

[75] Inventors: Danny O. Wright, Grafton, Va.; Michael A. Pauwels, Birmingham, Mich.

[73] Assignee: Allied Corporation, Morris Township, N.J.

[21] Appl. No.: 775,852

[22] Filed: Sep. 13, 1985

[51] Int. Cl.[4] ..... H05B 1/02; F02M 51/00

[52] U.S. Cl. ..... 219/501; 219/518; 219/205; 219/207; 219/497; 219/494; 123/179 L; 123/490; 123/478

[58] Field of Search ..... 219/518, 202, 497, 203, 219/499, 205, 207, 490, 491, 494, 501; 123/490, 491, 492, 179 L, 478

[56] References Cited

U.S. PATENT DOCUMENTS

| | | | |
|---|---|---|---|
| 3,959,692 | 5/1976 | Wetzel | 219/499 |
| 4,148,282 | 4/1979 | Grassle et al. | 123/179 L |
| 4,492,913 | 1/1985 | Arnold et al. | 123/490 |
| 4,512,317 | 4/1985 | Pauwels et al. | 123/490 |
| 4,522,177 | 6/1985 | Kawai et al. | 123/491 |
| 4,550,373 | 10/1985 | Ito et al. | 123/491 |
| 4,563,994 | 1/1986 | Ujihashi | 123/491 |

*Primary Examiner*—M. H. Paschall
*Attorney, Agent, or Firm*—Russel C. Wells; Markell Seitzman

[57] ABSTRACT

A temperature compensation injector control system as used in an electronic fuel injection system for motor vehicles utilizes the value of the voltage levels across the coil (18) to determine the coil's (18) temperature. A multiplexer (20) responds to the value of the source of power (14) and the voltage drop across the coil (18) created by a small leakage current to generate digital signals to a microprocessor (10) for modifying injector control signals.

3 Claims, 1 Drawing Figure

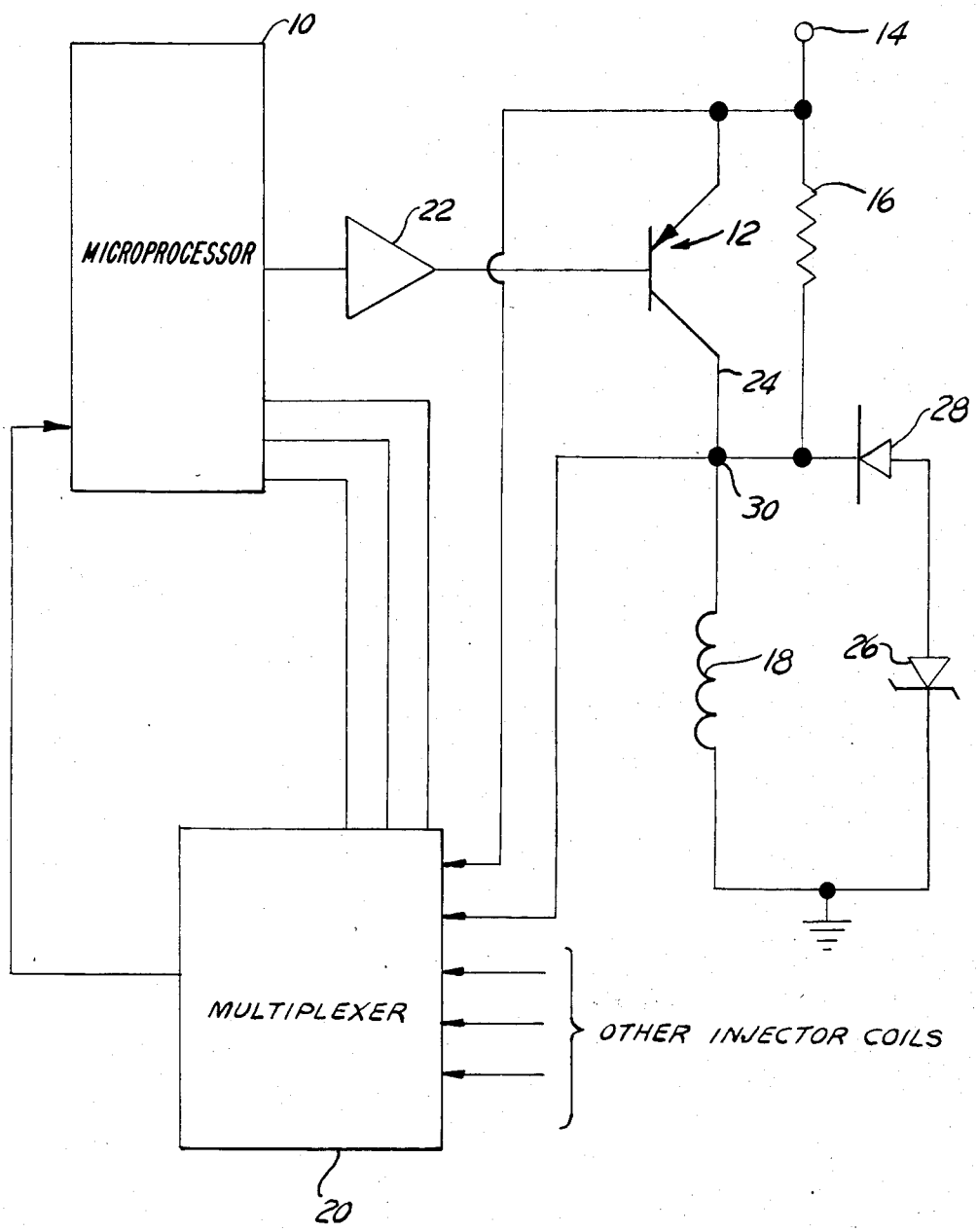
10
14
MICROPROCESSOR
22
12
16
24
28
30
18
26
MULTIPLEXER
OTHER INJECTOR COILS
20

TEMPERATURE COMPENSATION INJECTOR CONTROL SYSTEM

BACKGROUND OF INVENTION

This invention relates to temperature compensation control systems in general and in particular to control systems for electronic fuel injection systems having electromechanical fuel injectors wherein the control signal for operating the injector is modified according to the temperature of the injector coil.

SUMMARY OF THE INVENTION

In electronic fuel injection systems it is a distinct economic advantage to provide high resistance injector coils for fuel injectors. A high resistance coil can be driven with a saturating transistor switch connecting a source of electric power to the injector coil. This significantly reduces the power dissipation in the circuit as well as allows the utilization of lower cost transistors.

However, the trade-offs necessary with use of the high resistance coil require that the holding current, for holding the injector open, generates significant heat in the coil. The generated heat raises the temperature of the injector coil, thereby changing its resistance and hence its operating time and the fuel flow characteristics of the injector.

In many fuel injector drive circuits, there are many schemes which have been used to detect and correct for short and open circuits in the fuel injector circuits. Some shorts can cause an "always on" condition resulting in poor performance and even engine damage. A shorted injector can damage the driver circuitry by dissipating too much power thereacross.

In order to solve the problems identified above, a temperature compensation injector control system is connected to a source of electric power and has a microprocessor with input/output ports for receiving and sending control signals. The microprocessor has stored control laws for generating pulse width injector control signals for operating injectors according to engine operating parameters. The control signals control a powr switch means, such as a power transistor, for switching the electric power to at least one injector coil for injecting fuel into an engine.

A bypass resistance means is electrically connected in parallel with the power switch means supplying a leakage current to the injector coil. A multiplexing means in electrically connected to the injector coil and the microprocessor and is controlled by control signals from the microprocessor to receive analog voltage signals from the junction of the bypass resistance means and the injector coil. The value of the analog voltage signal is proportional to the temperature of the resistance of the injector coil. The higher the resistance, the more power is needed to open the injector and a longer time is needed to open the injector.

In response to control signals from the microprocessor, the multiplexer transmits digital signals representing the analog voltage signals to the microprocessor. A calculating means in the microprocessor is responsive to the digital signals received from the multiplexer and the value of the source of electric power to generate signals adjusting the pulse width of the injector control signals according to the resistance value of the injector coil.

The calculating means responds to a digital signal indicating that the analog voltage and the value of the source of electric power are equal indicating that the injector coil is electrically open and operates to delete or reduce the pulse width of the injector control signal. Further, the calculating means responds to a digital signal indicating that the analog voltage is equal to ground level showing that the injector coil is electrically short. When this happens, the calculating means operates to delete the pulse width of the injector control signal to prevent the turning on of the power switch means. This protects the power switch means and avoids dissipating a large amount of power across the switch means.

BRIEF DESCRIPTION OF THE DRAWING

These and other advantages of the temperature compensation control system will become apparent from the following detailed description and single FIGURE which is a schematic of the control system.

DETAILED DESCRIPTION OF THE PREFERRED EMBODIMENT

Referring to the sole FIGURE, there is illustrated a temperature compensation control system as may be found in an electronic fuel injection system. The system has, among other elements which are not shown, a microprocessor 10, a power switch means 12, a source of electric power 14, a bypass resistance means 16, at least one injector coil 18 and an analog to digital multiplexer 20. If the fuel injection system is a multipoint system, other injector coils and power switch means will be present and the multiplexer will receive inputs from the other injector coils. Various sensors, which are well known in fuel injection systems, are not shown.

The microprocessor 10 is any one of the well known units which are commercially available such as the Motorola MC6801. The microprocessor based system is that shown and claimed in a copending patent application having U.S. Ser. No. 499,110, now U.S. Pat. No. 4,556,943 issued Dec. 3, 1985, entitled "Multiprocessing Microprocessor Based Engine Control System for An Internal Combustion Engine", which was filed on May 27, 1983, and assigned to a common assignee. That application is incorporated herein by reference.

Stored within the microprocessor 10 in the memories contained therein, are a plurality of control laws for operating the fuel injection system. One such group of control laws operates in response to various engine operating parameters, to generate injector control signals having a pulse width equal to the operate time of the injector. The pulse width is proportional to the amount of fuel to be injected into the engine. The engine operating parameters are supplied to the microprocessor 10 by means of several sensors which are not shown.

Connected to the output of the microprocessor 10 and responsive to the pulse width injector control signals is a power switch means or power transistor 12 having a pre-driver stage 22. The pre-driver stage 22 receives the control signal from the microprocessor 10 and conditions the signal for operating the power transistor 12. In the preferred embodiment, the power transistor 12 is shown as an PNP transistor, although depending upon the polarity of the electric power source 14 and other circuit parameters, other types of transistors may be used, such as NPN transistors, FET's, etc.

Connected to the collector lead 24 of the power transistor 12 is the coil 18 of the fuel injector which is not shown. The coil 18 is connected in circuit with a voltage regulating or zener diode 26 for controlling the dissipation of electric energy from the coil 18 and a clamp diode 28. The coil responds to the pulse width time to open the injector for the discharge of fuel. The pre-driver also provides a reduced holding voltage level control signal to the power transistor to lower the power required to hold the injector open.

Across the power transistor 12 and in electrical parallel thereto, is a bypass resistance means 16 in the form of a resistor. The function of the bypass resistance means 16 is to provide a predetermined leakage current from the source of electric power 14 to the injector coil 18. Such leakage current will not be sufficient to either operate the injector or hold the injector open.

Connected to the junction 30 of the bypass resistance means 16 is an analog mutiplexing means 20 such as Motorola 14442. The multiplexing means 20 receives signals from the electric power source 14 indicating the value of the source and from any other injector-bypass resistance means junctions. The multiplexing means 20 also receives control signals from the microprocessor which activates its output ports to transmit digital signals to the microprocessor 10. These digital signals are representative of the value of the electric power source 14 and the voltage level at the junction 30 of the power switch means 12 and the injector coil 18.

The outputs of the multiplexing means 20 are supplied to the microprocessor 10 and in particular they are used under control of programs stored therein, to calculate the value of the resistance of each injector coil 18. This value is then used to modify the calculation of the pulse width of the injector control signal. As an example, if the resistance of the injector coil 18 is high, the pulse width may be lengthen so that the proper amount of fuel will be injected into the engine. If the resistance of the injector coil 18 is low, the pulse width will be shortened. As stated previously, the length of the pulse width is proportional to the amount of fuel to be injected into the engine.

The value of the digital signals also indicates the temperature of the injector coil 18. As an example, if the coil is wound with a positive temperature coefficent wire, the increase in the voltage drop across the coil 18 indicates a temperature rise over the normal or cold temperature condition of the coil 18. Two extreme conditions of the voltage levels at the junction 30 are of particular importance because the indicate a possible malfunction or failure in the system.

These two extreme conditions are when the coil 18 is electrically shortened and when the coil is electrically open. When the coil is electrically shortened, the voltage at the junction 30 is substantially equal to ground level. When this condition exists, the dissipation of power across the emitter-collector circuit of the power transistor 12 may well exceed the power rating of the transistor 12 and cause transistor failure.

When the coil 18 is electrically open, the voltage at the junction 30 is substantially equal to the value of the electric power source 14. In this condition, the injector will fail to operate correctly and the engine will not perform as desired. The power transistor 12 will not have any current through the emitter-collector lead.

In either case, the system could be modified to generate a failure indicator which may be transmitted to the operator of the motor vehicle or a flag may be set in the program stored in the microprocessor 10.

There has thus been described a temperature compensation control system for a fuel injected motor vehicle which monitors the temperature of the injector coils and modifies the control pulse width to the injector. This modification will cause the injector to operate in such a manner so as to deliver the designed and proper amount of fuel to the engine for each injection.

What is claimed is:

1. A temperature compensation injector control system having a source of electric power, a microprocessor having input/output ports for receiving and sending control signals and stored control laws for generating injector control signals having a pulse width for operating the injectors, power switch means responsive to the injector control signals for switching the electric power and at least one injector coil electrically connected in circuit with the power switch means and responsive to the switched electric power for injecting fuel the improvement comprising:

bypass resistance means electrically connected in parallel with the power switch means and to the at least one injector coil for supplying a leakage current to the at least one injector coil;

multiplexing means electrically connected to the at least one injector coil and the microprocessor and controlled by control signals from the microprocessor for receiving voltage signals from the injector coil and operative in response to the control signals for transmitting digital signals representing said voltage signals to the microprocessor; and calculating means in the microprocessor means responsive to said digital signals from said multiplexing means and the source of electric power for generating signals adjusting the pulse width of the injector control signals according to the resistance value of the injector coil and the source of electric power.

2. A temperature compensation injector control system according to claim 1 wherein said calculating means is responsive to said digital signals indicating that the at least one injector coil is electrically open and operative to delete said pulse width from the injector control signals.

3. A temperature compensation injector control system according to claim 1 wherein said calculating means is responsive to said digital signals indicating that the at least one injector coil is electrically short and operative to delete said pulse width from the injector control signals.

* * * * *